US011852454B2

(12) United States Patent
Futtere

(10) Patent No.: US 11,852,454 B2
(45) Date of Patent: Dec. 26, 2023

(54) BROADHEAD BLADE GRAVITY LOCK AND INERTIA RELEASE APPARATUS AND METHOD

(71) Applicant: Matthew Futtere, Fredericksburg, TX (US)

(72) Inventor: Matthew Futtere, Fredericksburg, TX (US)

( * ) Notice: Subject to any disclaimer, the term of this patent is extended or adjusted under 35 U.S.C. 154(b) by 0 days.

(21) Appl. No.: 17/985,996

(22) Filed: Nov. 14, 2022

(65) Prior Publication Data

US 2023/0089275 A1 Mar. 23, 2023

Related U.S. Application Data

(60) Provisional application No. 63/280,200, filed on Nov. 17, 2021.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,066,021 A * 11/1991 DeLucia ..... F42B 6/08 473/583
6,174,252 B1 * 1/2001 Mizek ..... F42B 6/08 473/583
7,393,295 B1 * 7/2008 Futtere ..... F42B 6/08 473/583
7,713,152 B1 * 5/2010 Tentler ..... F42B 6/08 473/583
8,043,177 B2 * 10/2011 Flanagan ..... F42B 6/08 473/583
8,894,519 B2 * 11/2014 Young ..... F42B 6/08 473/583
8,905,874 B2 * 12/2014 Sullivan ..... F42B 6/08 473/583
11,448,492 B1 9/2022 Futtere
11,774,222 B1 * 10/2023 Futtere ..... F42B 6/08 473/583

* cited by examiner

*Primary Examiner* — John A Ricci
(74) *Attorney, Agent, or Firm* — J. Nevin Shaffer, Jr.

(57) ABSTRACT

A broadhead blade gravity lock and inertia release apparatus and method consists of a. support structure with a locking pin channel. A blade is attached with the support structure such that the blade is movable from a first position to a second position. A pressure device is connected with the blade where the pressure device is configured to apply pressure to the blade. A locking pin is located in the locking pin channel where the locking pin is free to move toward and away from the blade within the locking pin channel and where the locking pin is configured to releasably connect with the blade such that when the blade is connected with the locking pin the blade is held in the first position by the pressure on the blade and where compressive force on the blade releases the blade from the locking pin such that the pressure device then pressures the blade to the second position and where, when connection with the blade is removed, the locking pin is free to move away from the blade within the locking pin channel.

20 Claims, 2 Drawing Sheets

BROADHEAD BLADE GRAVITY LOCK AND INERTIA RELEASE APPARATUS AND METHOD

CROSS REFERENCE TO RELATED APPLICATION

This application claims the benefit of previously filed U.S. provisional patent application No. 63/280,200 filed Nov. 17, 20211 for a "Broadhead Blade Gravity Lock and Inertia Release Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a broadhead blade gravity lock and inertia release apparatus. According to one embodiment, a broadhead blade gravity lock and inertia release apparatus consists of a support structure with a locking pin channel. A blade is attached with the support structure such that the blade is movable from a first position to a second position. A pressure device is connected with the blade where the pressure device is configured to apply pressure to the blade. A locking pin is located in the locking pin channel where the locking pin is free to move toward and away from the blade within the locking pin channel and where the locking pin is configured to releasably connect with the blade such that, when the blade is connected with the locking pin, the blade is held in the first position by the pressure on the blade and where compressive force on the blade releases the blade from the locking pin such that the pressure device then pressures the blade to the second position and where, when connection with the blade is removed, the locking pin is free to move away from the blade within the locking pin channel.

BACKGROUND OF THE INVENTION

Humane hunting requires a system for killing prey quickly. Problems exist with current hunting devices, bows and arrows and projectiles in particular, in that, for example, the killing area of the arrow or projectile is difficult to expand without introducing detrimental side effects.

A "broadhead", as is known in the art, is the sharpened implement mounted on the end of the shaft of an arrow that provides the penetrating and cutting mechanism which results in the ethical and humane killing of the hunted animal. While broadheads are useful hunting tools, they would be even more useful if they could be accurately delivered to the desired area of the animal. The evolution of the broadhead has gone from fixed bladed designs to "mechanical" designs. The "mechanical broadheads" are mechanically complex devices which deploy cutting blades at impact with a target. In particular, the blades of all mechanical broadheads remain dependent upon removing forward momentum energy and transferring some of it for use in overcoming the restrictive devices placed upon the blades that are intended to prevent premature deployment. The amount of momentum energy that is required to overcome the prior art devices varies but is of a significant enough magnitude that it prevents ethical use of mechanical broadheads by those bow hunters shooting legal, but less poundage of pull bows.

In addition, the momentum energy removed from the forward motion to force blades to deploy delivers a direct and negative outcome to target recovery rates due to not obtaining an exit wound. This is especially critical on marginally hit animals. In short, typically, prior art designs are required to remove enough energy so as to generate enough force, for example, to overcome a large magnitude of friction, to break rubber bands, to shatter and/or permanently disfigure plastic collars, and/or to cut through plastic pins or to cut O-rings. This reduction of energy reduces the efficacy of prior art mechanical blades with their one time use disposable blade holding mechanisms.

Further, with the advent and availability of improved materials, the bow or crossbow for delivering the arrow has also improved considerably. Compound bows and crossbows are much more efficient than traditional equipment and result in the capability to launch arrows at considerably higher velocities. Unfortunately, these higher velocities introduce significant acceleration forces upon the broadhead. Even a slight momentary opening of a blade and re-closure from a closure mechanism that uses an elastic material results in significant erratic accuracy. This is a major problem and has resulted in increasing the "strength" of the closure mechanisms. This, however, increases the amount of energy required to be used in defeating the closure mechanism and further compounds the problem by reducing penetrating power where lethality studies demonstrate improvement to recovery rates of hit animals when complete pass thru of the target animal is achieved.

In short, there is a need in the art for maintaining effective control of blades from transport in the field, absorption of launch energies at moment of shot taken, through air and at impact with the target animal. It is crucial to success to amplify the efficiency and effectiveness of the use of forward momentum energy. In addition, it is desirable to ensure maintenance of structural integrity through mechanical simplicity so as to provide a narrow profile in flight and a maximum cutting surface length. While transiting the target animal while maximizing efficient use of the majority of the forward momentum energy and the stored kinetic energy to humanely impact, completely pass through and quickly and ethically kill the targeted game animal are also desirable.

It is appropriate to note that Applicant has created a superior broadhead blade and air flow equalizer apparatus and method as set forth in his U.S. Pat. No. 7,393,295 incorporated herein by reference. Further, Applicant has obtained U.S. Pat. No. 11,448,492, incorporated by reference herein, for a "Broadhead Blade Lock and Release Apparatus and Method" that describes a unique lock and release device. This provisional discloses an alternative lock and release mechanism that also enables one, two, three or more spaced apart blades to be effectively and efficiently locked and released as will be described more fully herein.

As before, this invention is most particularly suited for a broadhead designed for use in hunting of big game. As a result, problems still exist in the art as set forth above for pursuing big game animals. As such there is a need in the art for an apparatus and method for use with structures such as arrows, projectiles and such, that increases the area of impact without decreasing the important aspects of accuracy and maximum penetration and lethal cutting upon impact and thru the target animal. That is, there is a need for a broadhead arrow, for example only, with a wide impact area that maintains target tip like accuracy at any arrow velocity, that incorporates the ability to transit bone structures such as a rib cage in a game animal in a manner that significantly minimizes the amount of momentum energy lost to penetration, minimizes deflection, that reduces lateral drag on the arrow shaft, and that provides broad, lethal cutting surface exposure at all times. Further there is a need for a broadhead that is able during hard bone structure penetration to pass it with minimal momentum energy loss, yet which presents maximum cutting width within soft tissue vital organs once the cutting surfaces transit past the harder chest cavity surfaces such as rib cage bones both during entry and exit of the chest cavity and that is able to again exit the ribbed chest cavity should hard bone be encountered attempting to prevent continued penetration. Further, a need exists for an easy to attach and failure resistant broadhead that maximizes mechanical simplicity of design and increased structural integrity and that does not act as a barb when withdrawn.

By way of further explanation, all mechanical broadheads require momentum energy removed from the finite energy transferred to them from the bow at release to penetrate an object to overcome the resistance of the various mechanisms used in prior art devices to hold blades closed from launch to impact. At impact with the target, movement of the blade is used to overcome the resistance mechanism used to prevent premature blade opening. Typical mechanisms used in the prior art are rubber bands, O-rings, plastic pins or plastic collars and similar friction inducing holding devices.

Such devices create problems, however. At launch from zero feet per second to some significantly higher feet per second, acceleration forces are applied to prior art designs that often cause momentary exposure of blade to air stream and/or complete breakdown of the holding mechanism resulting in full premature deployment of the blade or blades both of which cause a decrease in accuracy and penetrating force at impact.

In addition, through normal transport of broadheads in the field, blades can and are often bumped and banged or catch upon things. This often results in allowing momentary, partial to full, premature deployment prior to launch and creates additional problems. One prior art problem is safety due to exposing a user to cutting surfaces where none were expected. Additionally, accuracy issues are created by partial or premature deployment of the blades. Further, a user is unable to use a projectile that has been prematurely deployed until replacement of the holding device. That is, many prior art devices are not reusable as they are designed to he sacrificial in nature. In fact, the majority of mechanical broadhead blade holding designs currently on the market must be totally replaced when stretched out of shape or when being damaged beyond use.

At minimum, the prior art devices often create a need to reset blades and/or to reach for another undamaged arrow during a time of being close upon the target animal which adds unnecessary movement and thus amplifies failure of the hunt through scaring off of the always vigilant target animal.

Applicant has observed that efficiency of forward momentum energy use is critical to achieve the desired complete pass through of a broadhead apparatus so as to enhance quick and humane killing of the target animal. The prior art designs all use the forward momentum contained within the arrow/broadhead projectile upon impact to transfer energy to initiate the release of the mechanical devices. It has been observed that a large component of the forward momentum energy is used to initiate and complete the mechanical motion required break the device and release the blades to a fully operational position. This limits to a large degree the possible distance of the forward penetrating potential of the projectile.

The magnitude of wasted forward momentum energy being converted to other mechanical motion eliminates and/or significantly inhibits the efficacy of these devices and reduces the choices and or use of the mechanical category of broadheads by those who use minimum legal draw weights. That is, some users must use those lower poundage bows to hunt with, such as women and young adults. This limitation also prevents those who can shoot higher poundage pull bows that deliver higher momentum energy from using the prior art mechanical broadheads. That is, Applicant knows that users are told by professional hunters and outfitters for larger animals such as elk, moose, eland, kudo, buffalo, etc that they are not allowed to use mechanical broadheads due o the inherent lack of penetration they deliver due to the problems of momentum energy wasted.

Thus, there is a need in the art for a process that addresses the aforementioned problems in a manner that is robust and flexible so as to accommodate a full spectrum of broadhead design and use.

It therefore is an object of this invention to provide an improved broadhead blade lock and release apparatus for increasing the penetrating power of a broadhead without reducing speed and accuracy and structural integrity. Still further, it is an object of the invention to utilize gravity and inertia to enable the locking and unlocking of the blade(s).

SUMMARY

According to one embodiment, a broadhead blade gravity lock and inertia release apparatus consists of a support structure with a locking pin channel. A blade is attached with the support structuresuch that the blade is movable from a first position to a second position. A pressure device is connected with the blade where the pressure device is configured to apply pressure to the blade. A locking pin is located in the locking pin channel where the locking pin is free to move toward and away from the blade within the locking pin channel and where the locking pin is configured to releasably connect with the blade such that, when the blade is connected with the locking pin, the blade is held in the first position by the pressure on the blade and where compressive force on the blade releases the blade from the locking pin such that the pressure device then pressures the blade to the second position and where, When connection with the blade is removed, the locking pin is free to move away from the blade within the locking pin channel.

As used herein all terms are given their common, "ordinary" meaning. In particular, the term "blade" is used as discussed herein and illustrated in the figures to describe a generally flat device which has a length, width and thickness and whose width and length are much larger than the thickness. A knife blade for example, only. The term "pressure device" is used herein to describe a device that is resilient and that deforms under pressure but returns to a resting state or position after pressure is withdrawn. A resilient metal spring, for example only, once formed stays in a resting position and when pressure is applied deforms and once the pressure is released, the spring returns to its resting position. The pressure device also exerts a pressure against movement or a resisting pressure when pressure is applied. Many metal and plastic devices are known which exhibit such qualities and are well within the abilities of those of ordinary skill in the art.

In one aspect, the locking pin channel is configured to enable movement of the locking pin such that gravity causes the locking pin to move toward the blade when the support structure is held in one position.

In one aspect, the locking pin is located in front of the blade within the support structure such that gravity causes the locking pin to move toward the blade when the support structure is held vertically.

In another aspect, the locking pin channel is configured to enable movement of the locking pin such that inertia causes the locking pin to move within the locking pin channel away from the blade upon impact of the support structure with an object when the blade is released from connection with the locking pin.

In one aspect, the locking pin includes a locking lip and where the blade includes a locking lip connector configured to releasably connect the blade with the locking.

In one aspect, the blade includes a length with a first end and a second end and a locking pin connector where the locking pin connector is configured to connect the blade in the first position with the locking pin in the locking position.

In another aspect the locking pin connector is a receiver slot in the blade and the locking pin lip is configured to fit within the receiver slot such that the blade is retained in the first position. In a further aspect, the receiver slot includes a first edge and a second edge where the second edge extends past the first edge such that the second edge pushes away the locking pin in the locking pin channel as the blade moves toward the support structure.

One aspect further includes more than one blade.

According to another embodiment, a broadhead blade gravity lock and inertia release apparatus includes a support structure with a locking pin channel. Two blades are attached, one opposite from the other, with the support structure such that each blade is movable from a first position to a second position. A pressure device is connected with the two blades where the pressure device is configured to apply pressure to the two blades. A locking pin is located in the locking pin channel where the locking pin is free to move toward and away from the two blades within the locking pin channel and where the locking pin is configured to releasably connect with the two blades such that, when the two blades are connected with the locking pin, the two blades are held in the first position by the pressure on the two blades and where compressive force on the two blades releases the two blades from the locking pin such that the pressure device then pressures the two blades to the second position and where when connection with the two blades is removed the locking pin is free to move away from the two blades within the locking pin channel.

In one aspect, the locking pin channel is configured to enable movement of the locking pin such that gravity causes the locking pin to move toward the two blades when the support structure is held in one position.

In one aspect, the locking pin is located in front of the two blades within the support structure such that gravity causes the locking pin to move toward the two blades when the support structure is held vertically.

In another aspect, the locking pin channel is configured to enable movement of the locking pin such that inertia causes the locking pin to move within the locking pin channel away from the two blades when the two blades are released from connection with the locking pin upon compression of said two blades upon impact of the support structure with an object.

In one aspect, the locking pin includes a locking lip and where the two blades include a locking lip connector configured to releasably connect the two blades with the locking pin.

In another aspect, the two blades include a length with a first end and a second end and a locking pin connector where the locking pin connector is configured to connect the two blades in the first position with the locking pin in the locking position.

In another aspect, the locking pin connector is a receiver slot in the two blades and the locking pin lip is configured to fit within the receiver slot such that the two blades are retained in the first position. In one aspect, the receiver slot includes a first edge and a second edge where the second edge extends past the first edge such that the second edge pushes away the locking pin in the locking pin channel as the two blades move toward the support structure.

According to another embodiment, a broadhead blade gravity lock and inertia release method consists of:

a. providing a support structure with a locking pin channel; a blade attached with the support structure such that the blade is movable from a first position to a second position; a pressure device connected with the blade where the pressure device is configured to apply pressure to the blade; and a locking pin in the locking pin channel where the locking pin is free to move toward. and away from the blade within the locking pin channel and where the locking pin is configured to releasably connect with the blade such that when the blade is connected with the locking pin the blade is held in the first position by the pressure on the blade and where compressive force on the blade releases the blade from the locking pin such that the pressure device then pressures the blade to the second position and where, when connection with the blade is removed, the locking pin is free to move away from the blade within the locking pin channel; and b. connecting the blade with the locking pin.

In one aspect, the locking pin channel is configured to enable movement of the locking pin such that gravity causes the locking pin to move toward the blade when the support structure is held in one position and where the locking pin is located in front of the blade within the support structure such that gravity causes the locking pin to move toward the blade when the support structure is held vertically.

In a further aspect, the locking pin channel is configured to enable movement of the locking pin such that inertia causes the locking pin to move within the locking pin channel away frog the blade upon impact of the support structure with an object when the blade is released from connection with the locking pin upon compression of said two blades upon impact of the support structure with an object.

In another aspect, the pressure contact device is a ball bearing or similar lode bearing device which transfers stored spring energy to a blade or plurality of blades efficiently and with great minimization of wear surfaces via the friction induced via that mechanical interaction and repetitive motion.

In another aspect, the support structure includes a first end and a second end and where the first end is connected to an arrow shaft and where an arrow tip is connected with the second endo. In a further aspect, the first position is a fixed position away from the support structure, the second position is a position toward the arrow tip away from the first position and a third position during unlocking is a position inward from the first position toward the support structure.

In another aspect, the pressure device is a spring with a base topped with a hardened ball bearing or wear surface, a pressure contact device, connected with the blade or plurality of blades and placed under pressure.

In another aspect, the pressure device is a spring with a base topped with a hardened ball bearing or wear surface is connected with the blade or plurality of blades and placed under pressure.

In one aspect, the locking mechanism is moved and or/rotated to pass through that region of interaction. When pressure is removed from blade/plurality of blades at this position of the other blade/plurality of blades and/or trigger mechanism the primary blade/plurality of blades are physically prevented from opening with the receptive geometrical shape of primary blade interacting with the receptive geometrical shape of the trigger locking pin/inertia release mechanism.

DESCRIPTION OF DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
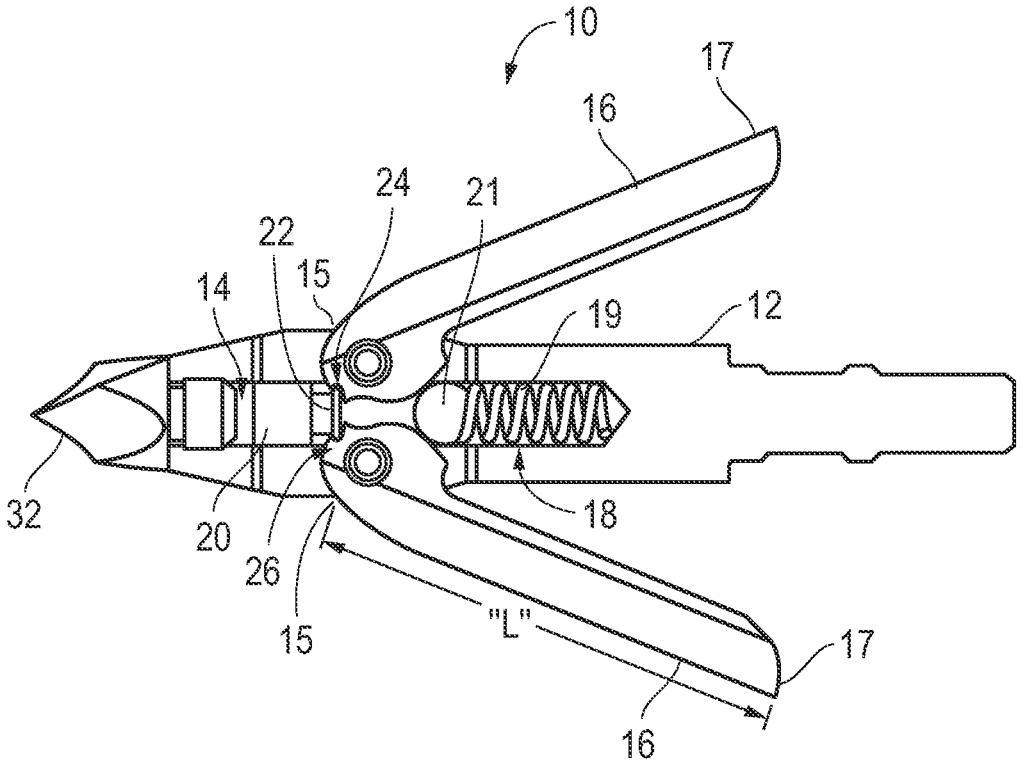
FIG. 1 is a top cut away view of the Broadhead blade gravity lock and inertia release apparatus of the present invention with the blades in the locked position.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily he utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
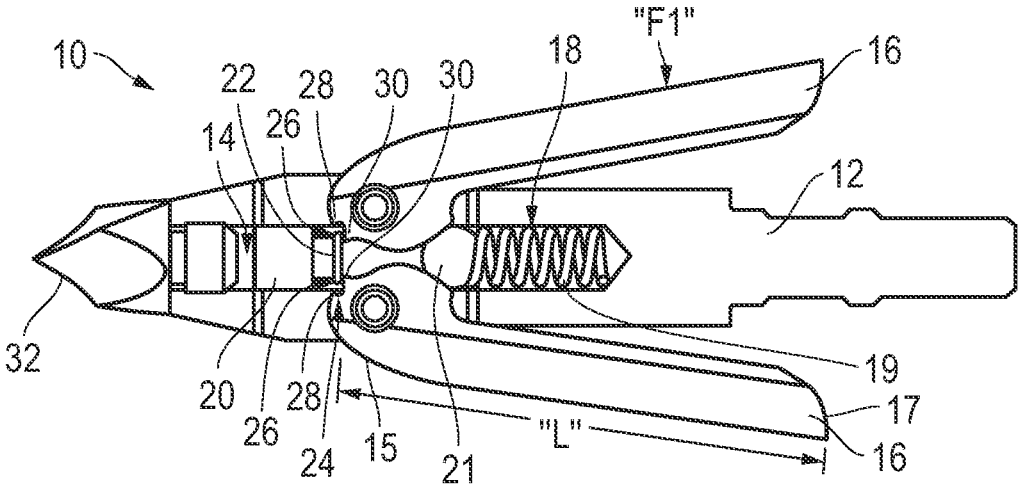
FIG. 2 is a top cut away view of the invention of FIG. 1 with the blades compressing to the unlocked position.
Figure 3:
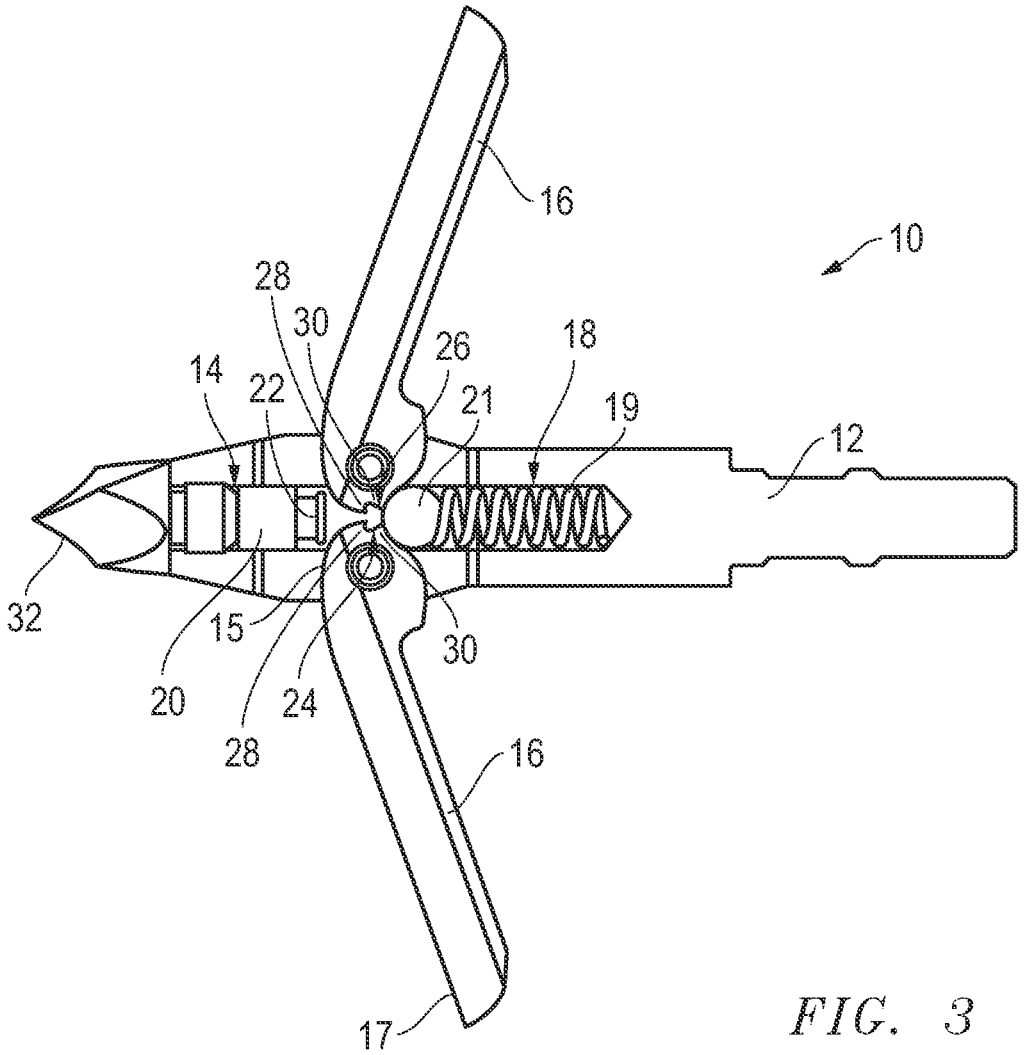
FIG. 3 is a top cut away view of the invention of FIGS. 1 and 2 illustrating the movement of the blades to the unlocked position and the locking pin moved away within the locking pin channel.

One embodiment of the present invention is illustrated by way of example in FIGS. 1-3. Referring to FIG. 1, a broadhead blade gravity lock and inertia release apparatus 10 includes a support structure 12 with a locking pin channel 14. Locking pin channel 14 is understood to describe a chamber within the structure as shown. A blade 16, or as shown in the figures, blades 16, is attached with the support structure 12 such that the blade 16 is movable from a first position as shown in FIG. 1 to a second position as shown in FIG. 3, described more fully hereafter.

A pressure device 18 is connected with the blade 16 where the pressure device 18 is configured to apply pressure to the blade 16. As shown, the blade 16 is formed such that contact with the blade 16 by the pressure device 18, when the blade 16 is in the locked position, holds the blade in the locked position. Preferably, the pressure device 18 includes a spring 19 with a hardened ball bearing 21 for a wear surface, as shown for example only and not by limitation in FIGS. 1, 2 and 3.

A locking pin 20 is located in the locking pin channel 14 where the locking pin 20 is free to move toward and away from the blade 16 within the locking pin channel 14. FIG. 1 shows the locking pin 20 moved within the locking pin channel 14 to blade 16 and connected with blade 16 such that blade 16 is locked in the first position as shown.

Locking pin 20 is configured to releasable connect with the blade 16 such that when the blade 16 is connected with the locking pin 20 the blade 16, again, is held in the first position by the pressure on the blade 16 from pressure device 18.

As shown in FIG. 2, compressive force "F1" on the blade 16, force applied when, for example the blade 16 enters an object, releases the blade 16 from the locking pin 20 such that the pressure device 18 then pressures the blade 16 to the second position shown in FIG. 3 once the blade 16 is released from connection with the locking pin 20. Further, when connection with the blade 16 is removed, the locking pin 20 is free to move away from the blade 16 within the locking pin channel 14, again as shown in FIG. 3.

Importantly, again, the locking pin channel 14 is configured to enable movement of the locking pin 20 such that gravity causes the locking pin to move toward the blade 16 when the support structure 20 is held in one position. For example only and not by limitation, when the locking pin 20 is located in front of the blade 16, as shown in the figures, within the support structure 12, gravity causes the locking pin 20 to slide within the locking pin channel 14 and move toward the blade 16 when the support structure 12 is held vertically.

In another aspect, the locking pin channel 14 is configured to enable movement of the locking pin 20 such that inertia causes the locking pin 20 to move within the locking pin channel 14 away from the blade 16, for example, when the blade 16 is released from connection with the locking pin 20 upon compressive force on the blade 16 upon impact of the support structure 12 with an object. That is, compressive force on the blade(s) 16 releases the blade(s) 16 from connection with locking pin 20. Also, support structure 12 slows upon impact and inertia causes the free moving locking pin 20, now released from connection with the blade 16, to continue forward within locking pin channel 14. This unique structure simply and easily moves locking pin 20 away from blades 16 enabling the blades 16 to expand to the full extended second position shown in FIG. 3 as a result of pressure from pressure device 18.

By way of further description, the locking pin 20 preferably includes a locking lip 22 and blade 16 includes a locking lip connector 24 configured to releasably connect the blade 16 with the locking pin 20 as illustrated. As shown, the blade 16 includes a length "L" with a first end 15 and a second end 17 and a locking pin connector 24 where the locking pin connector 24 is configured to connect the blade 16 in the first position with the locking pin 20 in the locking position shown in FIG. 1.

Preferably, the locking pin connector 24 is a receiver slot 26 in the blade 16 and the locking pin lip 22 is configured to fit within the receiver slot 26 such that the blade 16 is retained in the first position, again as shown in FIG. 1. Also, preferably, the receiver slot 26 includes a first edge 28 and a second edge 30 where the second edge 30 extends past the first edge 28 such that the second edge 30 pushes away the locking pin 20 in the locking pin channel 14 as the blade 16 is compressed and moves toward the support structure 12 as shown in FIG. 2 most clearly.

An important unique feature of the present invention is the ease with which the broadhead blade can be placed in the locked and ready to shoot position shown in FIG. 1. According to the present invention, to reset blades 16 and allow the broadhead to be shot again, a user simply compresses blades 16, points broadhead support structure 12 to the sky and allows gravity to move locking pin 20 downward within locking pin channel 14 to make contact with blades 16. Upon release of blades 16, the locking pin 20, locking lip 24, for example only, fits with the blade geometry, such as locking connector 24 receiver slot 26 for example only, within each 110 blade 16 and thus locks blades 16 into a "ready to shoot" first position".

Applicant has determined that this design requires the least amount of pieces/parts and is very easy and cost effective to manufacture. Due to so few movable parts, the present invention enhances tremendously the reliability of performance of a broadhead blade apparatus. The "Gravity Lock/Inertia Release" mechanism as described herein, in testing has not failed once to 115 operate properly. A critical need of bow hunters is to have their equipment perform flawlessly every shot and the present invention achieves that goal of reliable total performance that no other mechanical broadhead has ever achieved. This is a very critical and major positive step forward in the evolution of perfecting the complete performance capabilities of all big game animal broadheads by comparison.

By way of continued description, the novel broadhead blade gravity lock and inertia release apparatus 10 of the present invention utilizes the stored energy of an internal spring "pressure device" 18 to provide locking force. The internal spring causes a blade 16 or blades or plurality of blades to attempt to rotate away from a position that is specifically designed to connect at a locking location on a locking pin 20 and continuously prevent the expansion of primary blade 16 or blades when in the locked position. The mechanics of the interaction with an object, however, deliver a near zero use of forward momentum, inertia, to unlock the blade 16 or blades. It accomplishes this at impact of the blade 16 with an object by using the building compressive pressure upon the blade 16 edges toward the support structure 12. This minimum amount of energy is transferred to compress the blade 16 slightly. This slight movement of compressing a blade 16 or plurality of blades frees the mechanical connection of the blade 16 with the locking pin 20. The locking pin 20, with or without secondary blades, once disconnected from the blade 16 is free to move linearly or move in a combination of ways, out of the way within locking pin channel 14. Once the blade locking pin 20 and/or secondary blade has rotated/moved free and into its final position, the main blade 16 or plurality of main blades 16 are pressured by pressure device 18 to open to full cutting width to deliver maximum lethal damage, see FIG. 3. The present invention thereby delivering the most efficient and effective use of all available forward momentum energy to achieve the maximum desirable pass thru potential.

Continuing the description, support structure 12 typically includes an unmovable nose tip 32 or arrow point. Again, blade 16 is attached with the support structure 12 such that the blade 16 is movable from a first position ("locked" as in FIG. 1) to a second position ("unlocked" as in FIG. 3). Pressure device 18 is connected with the blade 16 where the pressure device 18 is configured to pressure the blade 16 to the second position when in contact with a free floating locking pin 20. Locking pin 20 is NOT connected to the nose tip 32 such that when the blade 16 is connected with the locking pin 20 the locking pin 20 is in locking position and the blade 16 or plurality of blades is held in the "locked" first position by the pressure on the blade 16 to the second position. Pressure on the blade 16 toward the support structure 12 releases the blade 16 from the free floating locking pin 20. Thereafter, deceleration of the broadhead tipped projectile, support structure 12, at impact reduces its velocity at a rate slower than the free floating locking pin 20. With the free floating locking pin 20 not captured by blades 26, it then easily moves forward within locking pin channel 14 due to inertia and physically removes itself from the critical interaction area between locking pin 20 and blades 16. Thus, with the mechanical interaction area between moveable locking pin 20 and blade 16 no longer capable of interaction or physical contact with each other, the pressure device 18 then pressures the blade 16 to rotate to the fully deployed "unlocked" position (see FIG. 3).

With regard to the two blade positions discussed herein, locked and unlocked, a major benefit of the locking pin 20 is that it enables the "locked" position which provides a narrow cutting width or blade stowed position ready to shoot. Once the blade or blades 16 is/are compressed, it can be said that the blade 16 is in the "unlocked" position intermediate between locked and fully open and provides an even narrower cutting width during compression. The filly open position is achieved once the lock pin 20 has moved by inertia to clear blade movement path. The blades 16 now are pushed via spring/ball bearing, pressure device 18, to the fully Open position. Typically, in this design, but not limited to these dimensions, the locked position provides approximately a 1.25" diameter of cut for blades; the compressed position a 1" diameter of cut for blades and the fully open position a 2.2" diameter of cut for blades to deliver full lethal enhancing cut capability.

The description of the present embodiments of the invention has been presented for purposes of illustration, but is not intended to be exhaustive or to limit the invention to the form disclosed. Many modifications and variations will be apparent to those of ordinary skill in the art, As such, while the present invention has been disclosed in connection with an embodiment thereof, it should be understood that other embodiments may fall within the spirit and scope of the invention as defined by the following claims.

What is claimed is:

1. A broadhead blade gravity lock and inertia release apparatus comprising:

a. a support structure with a locking pin channel;

b. a blade attached with the support structure such that the blade is movable from a first position to a second position;

c. a pressure device connected with said blade wherein said pressure device is configured to apply pressure to said blade; and d. a locking pin in said locking pin channel wherein the locking pin is free to move toward and away from said blade within said locking pin channel and wherein said locking pin is configured to releasably connect with said blade such that when the blade is connected with the locking pin said blade is held in the first position by the pressure on the blade and wherein compressive force on the blade releases the blade from the locking pin such that the pressure device then pressures the blade to the second position and wherein when connection with the blade is removed said locking pin is free to move away from said blade within the locking pin channel.

2. The apparatus of claim 1 wherein said locking pin channel is configured to enable movement of the locking pin such that gravity causes said locking pin to move toward said blade when said support structure is held in one position.

3. The apparatus of claim 2 wherein said locking pin is located in front of said blade within said support structure such that gravity causes said locking pin to move toward said blade when said support structure is held vertically.

4. The apparatus of claim 1 wherein said locking pin channel is configured to enable movement of the locking pin such that inertia causes said locking pin to move within said locking pin channel away from said blade when said blade is released from connection with the locking pin upon compression of said blade upon impact of the support structure with an object.

5. The apparatus of claim 1 wherein said locking pin includes a locking lip and wherein said blade includes a locking lip connector configured to releasably connect said blade with said locking pin.

6. The apparatus of claim 5 wherein the blade includes a length with a first end and a second end and a locking pin connector wherein the locking pin connector is configured to connect the blade in the first position with the locking pin in the locking position.

7. The apparatus of claim 6 wherein the locking pin connector is a receiver slot in the blade and the locking pin lip is configured to fit within the receiver slot such that the blade is retained in the first position.

8. The apparatus of claim 7 wherein the receiver slot includes a first edge and a second edge wherein the second edge extends past the first edge such that the second edge pushes away the locking pin in the locking pin channel as the blade moves toward the support structure.

9. The apparatus of claim 1 further including more than one blade.

10. A broadhead blade gravity lock and inertia release apparatus comprising:

a. a support structure with a locking pin channel;

b. two blades attached one opposite from the other with the support structure such that each blade is movable from a first position to a second position;

c. a pressure device connected with said two blades wherein said pressure device is configured to apply pressure to said two blades; and d. a locking pin in said locking pin channel wherein the locking pin is free to move toward and away from said two blades within said locking pin channel and wherein said locking pin is configured to releasably connect with said two blades such that when the two blades are connected with the locking pin said two blades arc held in the first position by the pressure on the two blades and wherein compressive force on the two blades releases the two blades from the locking pin such that the pressure device then pressures the two blades to the second position and wherein, when connection with the two blades is removed, said locking pin is free to move away from said two blades within the locking pin channel.

11. The apparatus of claim 10 wherein said locking pin channel is configured to enable movement of the locking pin such that gravity causes said locking pin to move toward said two blades when said support structure is held in one position.

12. The apparatus of claim 11 wherein said locking pin is located in front of said two blades within said support structure such that gravity causes said locking pin to move toward said two blades when said support structure is held vertically.

13. The apparatus of claim 10 wherein said locking pin channel is configured to enable movement of the locking pin such that inertia causes said locking pin to move within said locking pin channel away from said two blades when, upon compression of said two blades upon impact with an object, said two blades are released from connection with said locking pin.

14. The apparatus of claim 10 wherein said locking pin includes a locking lip and wherein said two blades include a locking lip connector configured to releasably connect said two blades with said locking pin.

15. The apparatus of claim 14 wherein the two blades include a length with a first end and a second end and a locking pin connector wherein the locking pin connector is configured to connect the two blades in the first position with the locking pin in the locking position.

16. The apparatus of claim 15 wherein the locking pin connector is a receiver slot in the two blades and the locking pin lip is configured to fit within the receiver slot such that the two blades are retained in the first position.

17. The apparatus of claim 16 wherein the receiver slot includes a first edge and a second edge wherein the second edge extends past the first edge such that the second edge pushes away the locking pin in the locking pin channel as the two blades move toward the support structure.

18. A broadhead blade gravity lock and inertia release method consisting of:

a. providing a support structure with a locking pin channel; a blade attached with the support structure such that the blade is movable from a first position to a second position; a pressure device connected with said blade wherein said pressure device is configured to apply pressure to said blade; and a locking pin in said locking pin channel wherein the locking pin is free to move toward and away from said blade within said locking pin channel and wherein said locking pin is configured to releasably connect with said blade such that when the blade is connected with the locking pin said blade is held in the first position by the pressure on the blade and wherein compressive force on the blade releases the blade from the locking pin such that the pressure device then pressures the blade to the second position and wherein when connection with the blade is removed said locking pin is free to move away from said blade within the locking pin channel; and b. connecting said blade with said locking pin.

19. The method of claim 18 wherein said locking pin channel is configured to enable movement of the locking pin such that gravity causes said locking pin to move toward said blade when said support structure is held in one position and wherein said locking pin is located in front of said blade within said support structure such that gravity causes said locking pin to move toward said blade when said support structure is held vertically.

20. The method of claim 18 wherein said locking pin channel is configured to enable movement of the locking pin such that inertia causes said locking pin to move within said locking pin channel away from said blade when, upon compression of said blade with an object, said blade is released from connection with said locking pin.

* * * * *